US007109951B2

(12) United States Patent
Kim et al.

(10) Patent No.: US 7,109,951 B2
(45) Date of Patent: Sep. 19, 2006

(54) METHOD AND APPARATUS FOR DRIVING PLASMA DISPLAY PANEL

(75) Inventors: Young Dae Kim, Busan-kwangyeokshi (KR); Sang Jin Yun, Kyoungsangbuk-do (KR); Yong Tae Jeon, Kyoungsan-shi (KR)

(73) Assignee: LG Electronics Inc., Seoul (KR)

( * ) Notice: Subject to any disclaimer, the term of this patent is extended or adjusted under 35 U.S.C. 154(b) by 289 days.

(21) Appl. No.: 10/757,475

(22) Filed: Jan. 15, 2004

(65) Prior Publication Data

US 2004/0155836 A1 Aug. 12, 2004

(30) Foreign Application Priority Data

Jan. 16, 2003 (KR) ..... 10-2003-0002856

(51) Int. Cl.
*G09G 3/28* (2006.01)
*G09G 3/10* (2006.01)

(52) U.S. Cl. ..... 345/63; 315/169.4

(58) Field of Classification Search ..... 315/169.1, 315/169.2, 169.4; 345/35.1, 36, 76, 78, 94, 345/105

See application file for complete search history.

(56) References Cited

U.S. PATENT DOCUMENTS

| | | | | |
|---|---|---|---|---|
| 6,288,692 | B1 * | 9/2001 | Kanazawa et al. | 345/67 |
| 6,528,952 | B1 * | 3/2003 | Kato et al. | 315/169.4 |
| 6,707,436 | B1 * | 3/2004 | Setoguchi et al. | 345/60 |
| 6,862,009 | B1 * | 3/2005 | Park | 345/67 |
| 6,876,343 | B1 * | 4/2005 | Myoung et al. | 345/67 |
| 6,906,690 | B1 * | 6/2005 | Lim | 345/60 |

* cited by examiner

*Primary Examiner*—Shih-Chao Chen
*Assistant Examiner*—Minh Dieu A
(74) *Attorney, Agent, or Firm*—Fleshner & Kim, LLP

(57) ABSTRACT

A method and apparatus for driving a plasma display panel for preventing and a spot misfire and a miswriting is disclosed. In the method, wall charges are formed at a discharge cell in an initial period. The discharge cell selects discharge cells in an address period. A wall charge control period is arranged between said initialization period and said address period. A wall charge distribution at the discharge cell is controlled in the wall charge control period. A sustain discharge is caused at discharge cells selected in said address period in the sustain period.

66 Claims, 8 Drawing Sheets

Set-down

METHOD AND APPARATUS FOR DRIVING PLASMA DISPLAY PANEL

BACKGROUND OF THE INVENTION

1. Field of the Invention

This invention relates to a plasma display panel, and more particularly to a method and apparatus for driving a plasma display panel that is adaptive for preventing and a spot misfire and a miswriting.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a scan electrode 30Y and a sustain electrode 30Z provided on an upper substrate 10, and an address electrode 20X provided on a lower substrate 18. Each of the scan electrode 30Y and the sustain electrode 30Z includes transparent electrodes 12Y and 12Z, and metal bus electrodes 13Y and 13Z having smaller line widths than the transparent electrodes 12Y and 12Z and provided at one edge of the transparent electrodes 12Y and 12Z.

The transparent electrodes 12Y and 12Z are usually formed from indium-tin-oxide (ITO) on the upper substrate 10. The metal bus electrodes 13Y and 13Z are usually formed from a metal such as chrome (Cr), etc. on the transparent electrodes 12Y and 12Z to thereby reduce a voltage drop caused by the transparent electrodes 12Y and 12Z having a high resistance.

On the upper substrate 10 provided, in parallel, with the scan electrode 30Y and the common sustain electrode 30Z, an upper dielectric layer 14 and a protective film 16 are disposed. Wall charges generated upon plasma discharge are accumulated onto the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphorous material 26. The address electrode 20X is formed in a direction crossing the scan electrode 30Y and the sustain electrode 30Z. The barrier rib 24 is formed in parallel to the address electrode 20X to thereby prevent an ultraviolet ray and a visible light generated by a discharge from being leaked to the adjacent discharge cells. The phosphorous material 26 is excited by an ultraviolet ray generated during the plasma discharge to generate any one of red, green and blue visible light rays. An inactive mixture gas for a gas discharge is injected into a discharge space defined between the upper and lower substrate 10 and 18 and the barrier rib 24.

Such a PDP makes a time-divisional driving of one frame, which is divided into various sub-fields having a different emission frequency, so as to realize gray levels of a picture. Each sub-field is again divided into an initialization period for initializing the entire field, an address period for selecting a scan line and selecting the cell from the selected scan line and a sustain period for expressing gray levels depending on the discharge frequency. Herein, the initialization period is again divided into a set-up interval supplied with a rising ramp waveform and a set-down interval supplied with a falling ramp waveform.

For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period and the number of sustain pulses assigned thereto are increased at a ratio of $2^n$ (wherein n=0, 1, 2, 3, 4, 5, 6 and 7) at each sub-field.

FIG. 3 shows a driving waveform of the PDP applied to two sub-fields. In FIG. 3, Y represents the scan electrode; Z does the sustain electrode; and X does the address electrode.

Referring to FIG. 3, the PDP is divided into an initialization period for initializing the full field, an address period for selecting a cell, and a sustain period for sustaining a discharge of the selected cell for its driving.

In the initialization period, a rising ramp waveform Ramp-up is simultaneously applied to the entire scan electrodes Y in a set-up interval. This rising ramp waveform Ramp-up causes a weak discharge within cells at the full field to generate wall charges within the cells. The rising ramp waveform Ramp-up rises from a sustain voltage Vs until a sum value of a set-up voltage Vsetup with the sustain voltage Vs.

In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field. In real, the falling ramp waveform Ramp-down falls from the sustain voltage Vs until a negative voltage −Vy so that desired wall charges can be left during the set-down interval.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the initialization period to thereby generate an address discharge within the cells supplied with the data pulse data. Wall charges are formed within the cells selected by the address discharge.

Meanwhile, a positive direct current voltage having a sustain voltage level Vs is applied to the sustain electrodes Z during the set-down interval and the address period.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrode Y and the common sustain electrode Z whenever each sustain pulse sus is applied. Finally, after the sustain discharge was finished, a erasing ramp waveform erase having a small pulse width is applied to the sustain electrode Z to thereby erase wall charges left within the cells.

In the set-up interval of such a convention PDP, the scan electrode Y is supplied with a positive voltage while the sustain electrode Z is supplied with a negative voltage (or a ground voltage). Accordingly, in the set-up interval, negative wall charges are formed at the scan electrode Y while positive wall charges are formed at the sustain electrode Z as shown in FIG. 4. The falling ramp waveform Ramp-down falling from a positive voltage lower than a peak voltage of the rising ramp waveform Ramp-up are supplied in the set-down interval. Thus, spurious wall charges formed excessively and non-uniformly are erased to thereby reduce the wall charges within the cell into a predetermined amount.

Subsequently, in the address period, the scan electrode Y is supplied with a negative voltage while the sustain electrode Z is supplied with a positive voltage. At this time, a voltage value (having a negative polarity) of wall charges formed in the set-down interval is added to a negative voltage value applied to the scan electrode Y, to thereby cause an address discharge.

The conventional PDP driven as mentioned above does not make a stable address discharge until desired wall charges are formed in the initialization period. However, in the conventional PDP, desired wall charges are not formed in the initialization period depending upon a property of the panel, and thus a spot misfire or a miswriting occurs.

More specifically, when wall charges are normally formed in the initialization period, negative wall charges are formed at the scan electrode Y while positive wall charges are formed at the sustain electrode Z as shown in FIG. 4. However, due to problems of the panel property, etc., positive wall charges are formed at the scan electrode Y of a portion of discharge cells during the set-down interval as shown in FIG. 5. In other words, the falling ramp waveform Ramp-down falls until a negative voltage −Vy in the set-down interval. At this time, positive wall charges are formed at the scan electrode Y provided at the portion of discharge cells. If positive wall charges are formed at the scan electrode Y as mentioned above, then a spot misfire or a miswriting is generated to thereby cause a deterioration of picture quality in the PDP.

SUMMARY OF THE INVENTION

Accordingly, it is an object of the present invention to provide a method and apparatus for driving a plasma display panel that is adaptive for preventing and a spot misfire and a miswriting.

In order to achieve these and other objects of the invention, a method of driving a plasma display panel according to one aspect of the present invention includes an initial period for forming wall charges at a discharge cell; an address period for selecting the discharge cell; a wall charge control period, being arranged between said initialization period and said address period, for controlling a wall charge distribution at the discharge cell; and a sustain period for causing a sustain discharge at discharge cells selected in said address period.

In the method, said initialization period is divided into a set-up interval and a set-down interval; a rising ramp, waveform rising at a first slope from a sustain voltage until a sum value of said sustain voltage and a set-up voltage; and a falling ramp waveform falling at a second slope from said sustain voltage until a negative voltage.

A control pulse having a voltage rising at said first slope from a ground voltage is applied to the scan electrode during said wall charge control period.

Herein, a voltage of said control pulse is a voltage less than said set-up voltage.

An application time of said control pulse is differentiated depending upon sub-fields.

Herein, an application time of said control pulse is set more shortly as it goes from a sub-field arranged in an initial time of a frame into the last sub-field of the frame.

Alternatively, an application time of said control pulse is set longer as it goes from a sub-field arranged in an initial time of a frame into the last sub-field of the frame.

Application time of said control pulse is equal to each other at the entire sub-fields included in one frame.

A ground voltage is applied to a sustain electrode arranged in parallel to the scan electrode during said wall charge control period.

A control pulse rising at a slope different from said first slope from a ground voltage is applied to the scan electrode during wall charge control period.

Alternatively, a rectangular control pulse having said sustain voltage is applied to the scan electrode during said wall charge control period.

Herein, said control pulse is applied during a time less than 1 μs.

An application time of said control pulse is differentiated depending upon sub-fields.

Application time of said control pulse is equal to each other at the entire sub-fields included in one frame.

A ground voltage is applied to a sustain electrode arranged in parallel to the scan electrode during said wall charge control period.

A driving apparatus for a plasma display panel according to another aspect of the present invention includes a set-up supplier for supplying a rising ramp waveform to scan electrodes during an initialization period; and a scan voltage supplier for sequentially supplying a scanning pulse to the scan electrodes during an address period, wherein the set-up supplier applies a control pulse rising at the same slope as said rising ramp waveform to the scan electrodes between said initialization period and said address period.

Herein, after said control pulse was supplied, a ground voltage is applied to the scan electrodes.

A driving apparatus for a plasma display panel according to still another aspect of the present invention includes a set-up supplier for supplying a rising ramp waveform to scan electrodes during an initialization period; a scan voltage supplier for sequentially supplying a scanning pulse to the scan electrodes during an address period; an energy recovering circuit for supplying a sustaining pulse having a sustain voltage during a sustain period; and a scan reference voltage supplier for supplying a scan reference voltage to the remaining scan electrodes other than said scan electrodes to which said scanning pulse is applied during said address period, wherein said energy recovering circuit applies a rectangular control pulse having said sustain voltage to the scan electrodes between said initialization period and said address period.

In the driving apparatus, prior to said control pulse was supplied, said scan reference voltage is applied to the scan electrodes.

Said control pulse is applied during a time less than 1 μs.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
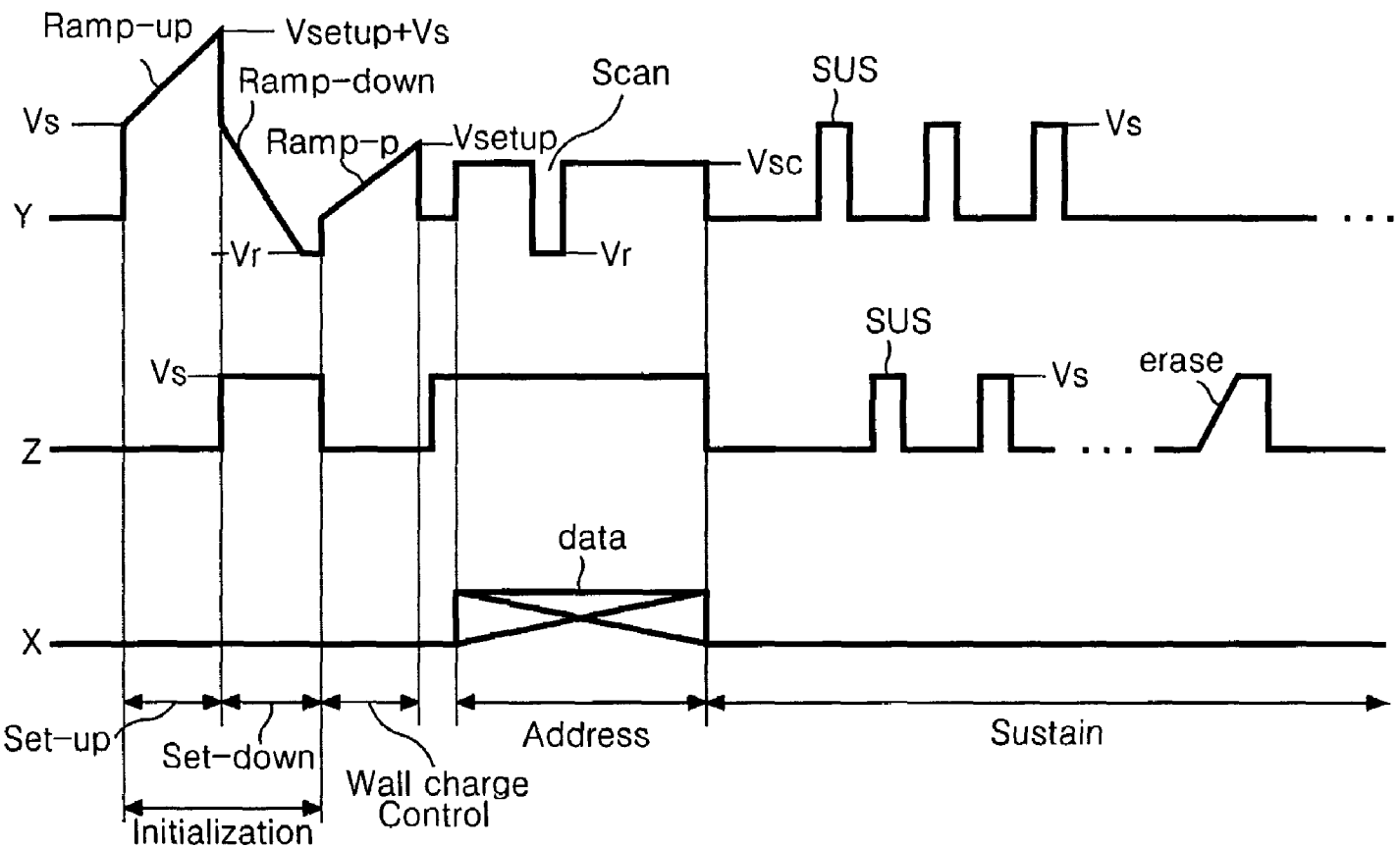
FIG. 6 is a waveform diagram for explaining a method of driving a plasma display panel according to a first embodiment of the present invention.

FIG. 6 shows a method of driving a plasma display panel (PDP) according to a first embodiment of the present invention.

Referring to FIG. 6, the PDP according to the first embodiment of the present invention is divided into an initialization period for initializing the entire field, a wall charge control period for preventing an inversion of wall charges, an address period for selecting a cell and a sustain period for sustaining a discharge of the selected cell for its driving.

In the initialization period, a rising ramp waveform Ramp-up is simultaneously applied to all of scan electrodes Y in a set-up interval. This rising ramp waveform Ramp-up causes a weak discharge within cells at the full field to generate wall charges within the cells. The rising ramp waveform Ramp-up rises from a sustain voltage Vs until a sum value of a set-up voltage Vsetup with the sustain voltage Vs.

In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field. In real, the falling ramp waveform Ramp-down falls from the sustain voltage Vs until a negative voltage −Vy so that desired wall charges can be left during the set-down interval.

In the wall charge control period, the scan electrodes Y are supplied with a positive control pulse Ramp-p rising from a ground voltage GND until a set-up voltage Vsetup. If the positive control pulse Ramp-p is applied to the scan electrodes Y, then a fine discharge is generated at the discharge cells to thereby control the polarities of the discharge cells into desired types.

Figure 1:
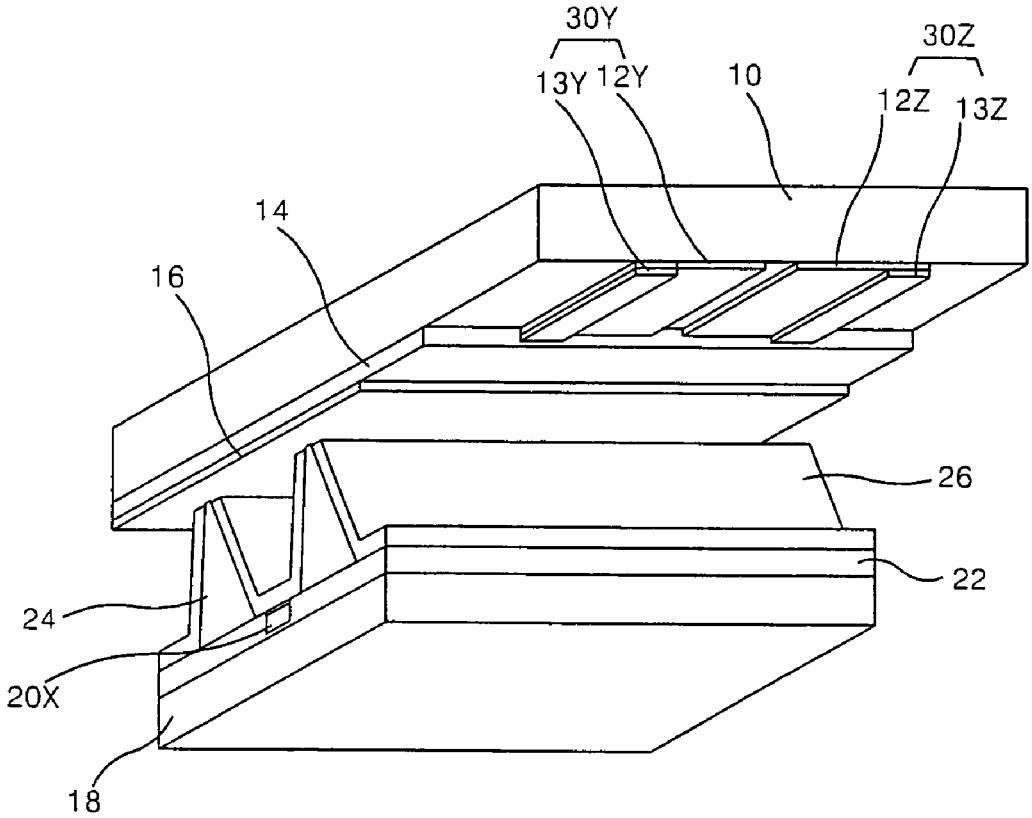
FIG. 1 RELATED ART
FIG. 1 is a perspective view showing a discharge cell structure of a conventional three-electrode, AC surface-discharge plasma display panel.
Figure 2:
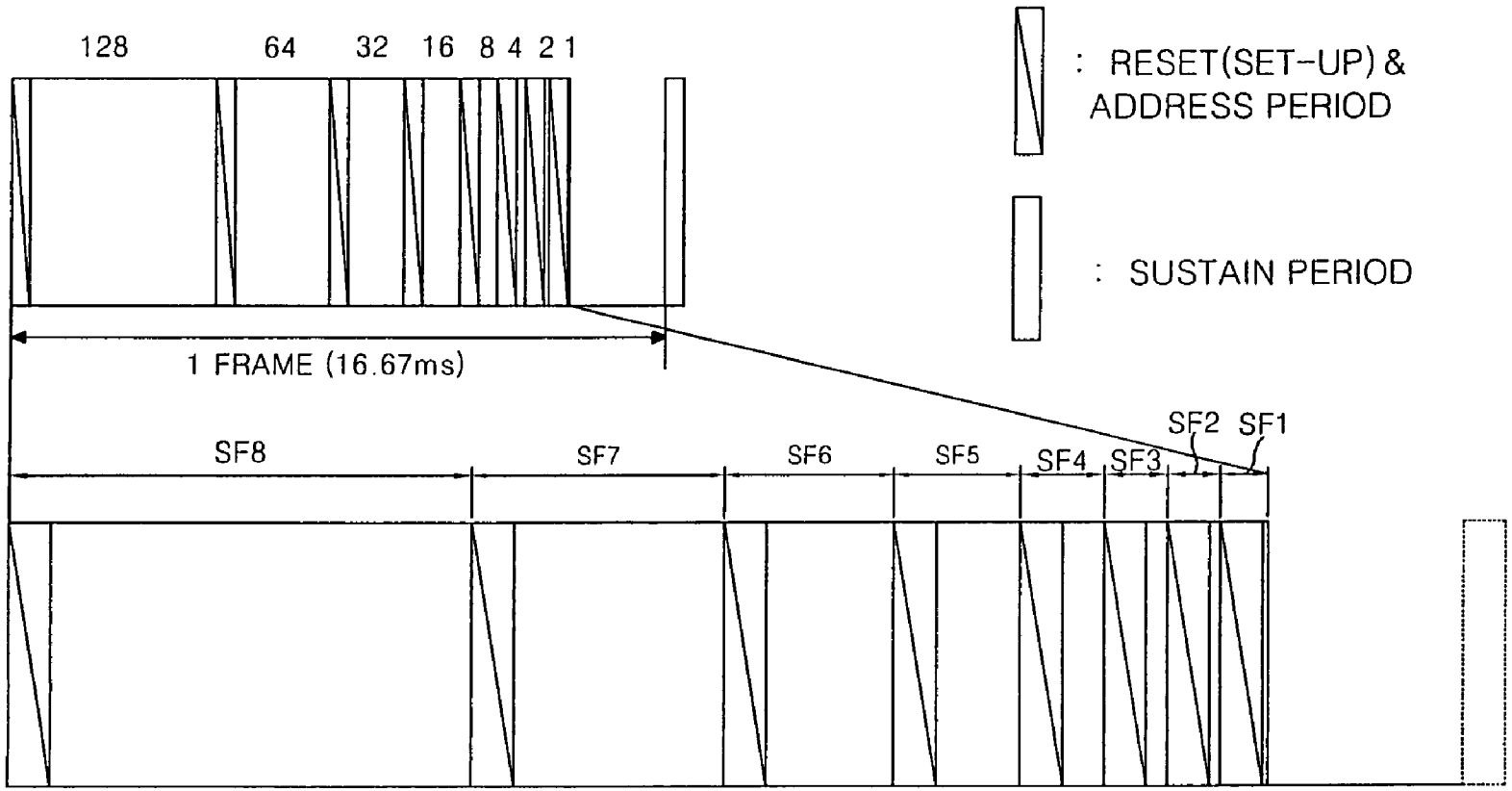
FIG.2 RELATED ART
FIG. 2 illustrates sub-fields included in one frame of the conventional plasma display panel.
Figure 3:
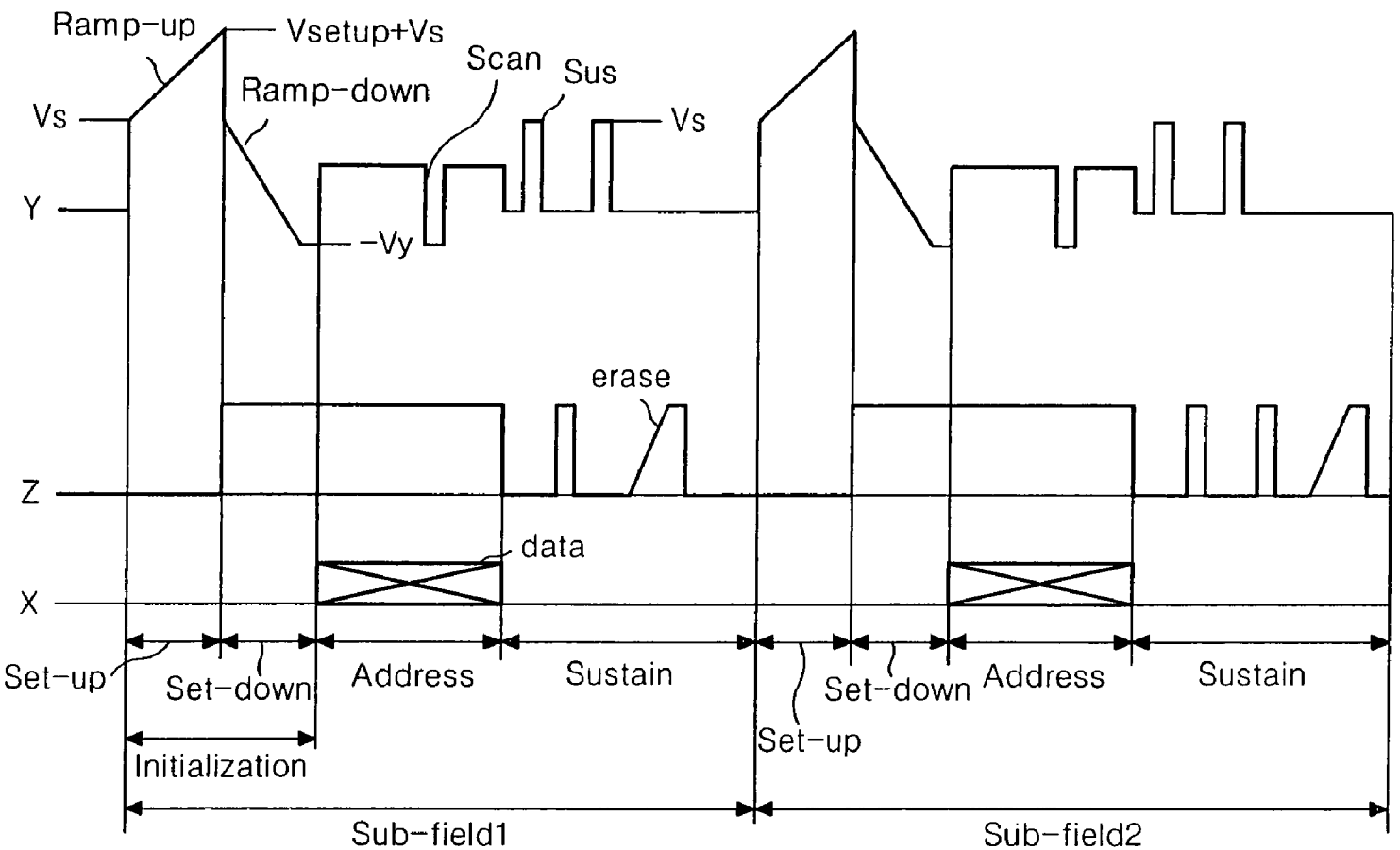
FIG.3 RELATED ART
FIG. 3 is a waveform diagram of driving signals supplied to the electrodes during the sub-fields shown in FIG. 2.
Figure 4:
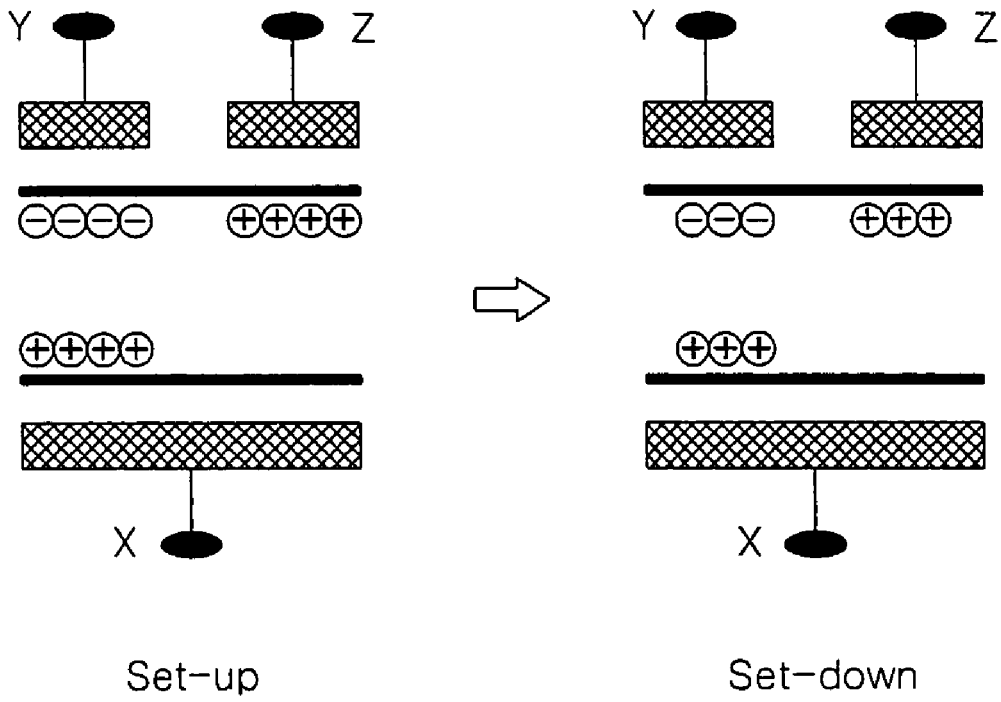
FIG. 4 RELATED ART
FIG. 4 depicts wall charges formed at the electrodes in the initialization period shown in FIG. 2.
Figure 5:
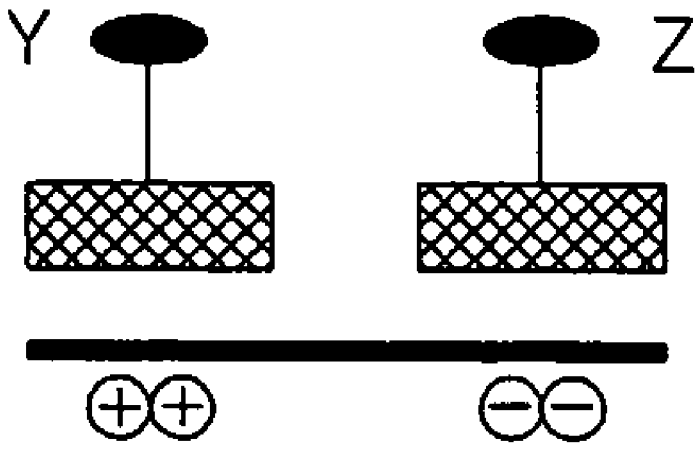
FIG. 5 RELATED ART
FIG. 5 depicts wall charges formed at a portion of discharge cells in the initialization period shown in FIG. 2.

More specifically, in the set-down interval, wall charges having an undesired type of polarities are formed at a portion of discharge cells as shown in FIG. 5. Thereafter, if the positive control pulse Ramp-p is applied to the scan electrodes Y, then a fine discharge is generated at the discharge cells to thereby form negative wall charges at the scan electrodes Y while forming positive wall charges at the sustain electrodes Z. In other words, in the embodiment of the present invention, the polarities of wall charges of the entire discharge cells can be controlled into desired polarities during the wall charge control period.

Meanwhile, an application time of the control pulse Ramp-p can be set in various methods. For instance, an application time of the control pulse Ramp-p may be set equally or differently for each sub-field. Herein, if an application time of the control pulse Ramp-p is set differently for each sub-field, then a voltage value of the control pulse Ramp-p also is set differently for each sub-field. In other words, an application time of the control pulse Ramp-p rising at the same slope is controlled, so that the control pulse Ramp-p having a different voltage value can be applied to each sub-field. Herein, an application time of the control pulse may be set to be shorter as it goes from the initial sub-field into the later sub-fields. Then, as it goes from the initial sub-field into the later sub-fields, a voltage value of the control pulse becomes lower. Alternatively, an application of the control pulse may be set to be longer as it goes from the initial sub-field into the later sub-fields. In real, an application time of the control pulse is experimentally determined in consideration of a length (i.e., inch) of the panel, a resolution of the panel and a process state, etc. Otherwise, the control pulse Ramp-p having different slope and/or voltage for each sub-field may be supplied.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the initialization period to thereby generate an address discharge within the cells supplied with the data pulse data. Wall charges are formed within the cells selected by the address discharge. In the above-mentioned embodiment of the present invention, negative wall charges are formed at the scan electrodes of the entire discharge cells during the wall charge control period to thereby cause a stable address discharge. Accordingly, it becomes possible to prevent a miswriting and/or a spot misfire.

Meanwhile, a positive direct current voltage having a sustain voltage level Vs is applied to the sustain electrodes Z during the set-down interval and the address period. Further, in the wall charge control period, the sustain electrodes Z are supplied with a ground voltage GND. The sustain electrodes Z are supplied with the ground voltage GND during the wall charge control period to thereby cause a stable intensified discharge.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrode Y and the common sustain electrode Z whenever each sustain pulse sus is applied. Finally, after the sustain discharge was finished, an erasing ramp waveform erase having a small pulse width is applied to the sustain electrode Z to thereby erase wall charges left within the cells.

Figure 7:
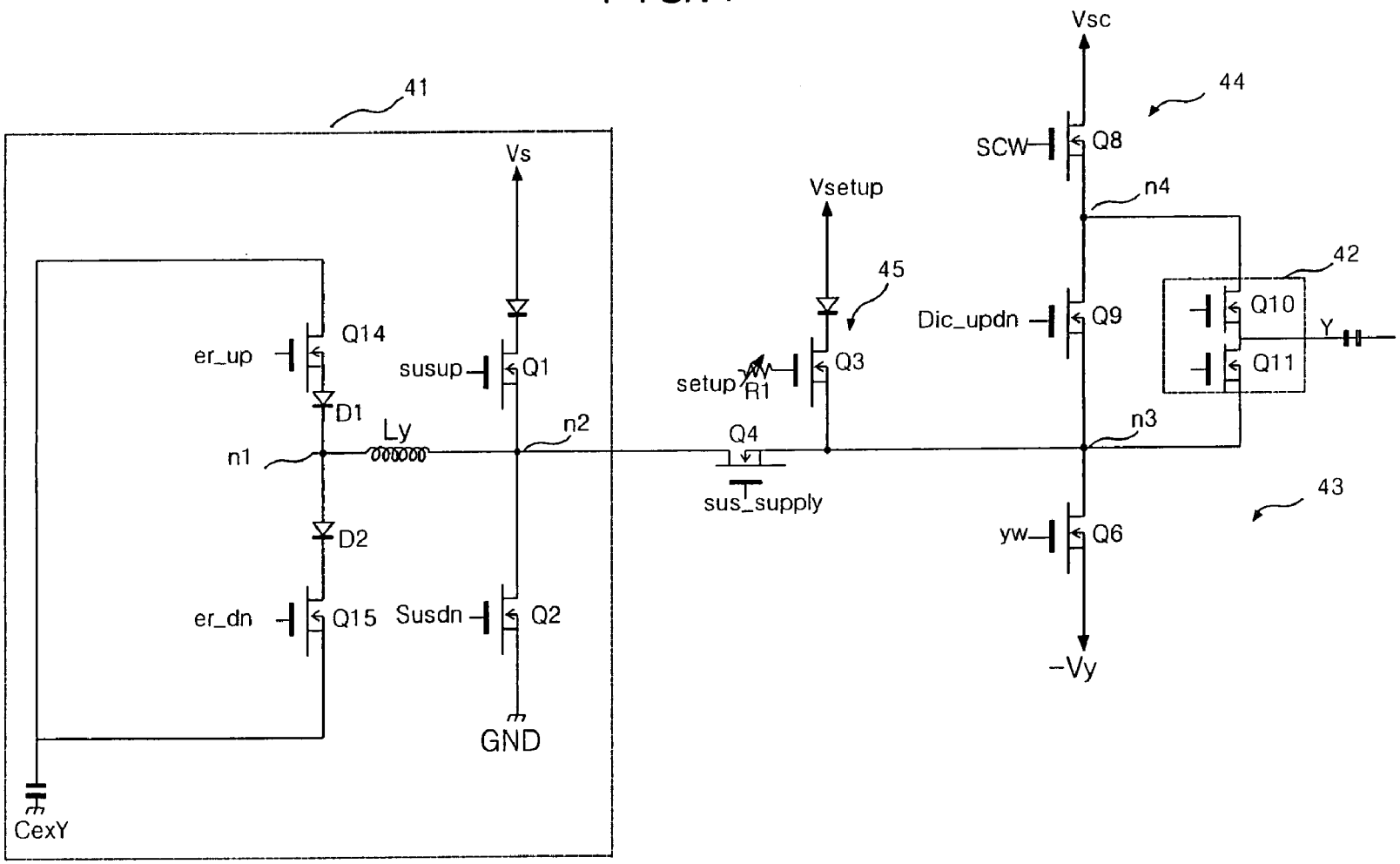
FIG. 7 is a circuit diagram of a driving apparatus for the plasma display panel according to an embodiment of the present invention.

FIG. 7 shows a scan electrode driver according to an embodiment of the present invention.

Referring to FIG. 7, the scan electrode driver includes an energy recovering circuit 41, a fourth switch Q4 connected between the energy recovering circuit 41 and a driving integrated circuit (IC) 42, a negative scan voltage supplier 43 and a scan reference voltage supplier 44 connected between the fourth switch Q4 and the driving IC 42 to apply a scanning pulse Scan, and a set-up supplier 45 connected among the fourth switch Q4, the negative scan voltage supplier 43 and the scan reference voltage supplier 44 to generate a rising ramp waveform Ramp-up.

The driving IC 42 is connected in a push-pull shape, and consists of tenth and eleventh switches Q10 and Q11 to which voltage signals from the energy recovering circuit 41, the scan voltage supplier 43 and the scan reference voltage supplier 44 are inputted. An output line between the tenth and eleventh switches Q10 and Q11 are connected to any one of scan electrode lines Y1 to Ym.

The energy recovering circuit 41 includes an external capacitor CexY for charging an energy recovered from the scan electrode lines Y1 to Ym, switches Q14 and Q15 connected, in parallel, to the external capacitor CexY, an inductor Ly connected between a first node n1 and a second node n2, a first switch Q1 connected between a sustain voltage supply Vs and the second node n2, and a second switch Q2 connected between the second node n2 and a ground voltage terminal GND.

An operation of the energy recovering circuit 41 will be described below.

First, it is assumed that a Vs/2 voltage has been charged in the external capacitor CexY. If the fourteenth switch Q14 is turned on, then a voltage charged in the external capacitor CexY is applied, via the fourth switch Q14, a first diode D1, the inductor Ly and the fourth switch Q4, to the driving IC 42 and, at the same time, is applied, via an internal diode (not shown), to the scan electrode lines Y1 to Ym. At this time, the inductor Ly configures a serial LC resonance circuit along with a capacitance C of the cell of the PDP to thereby apply a resonating waveform to the scan electrode lines Y1 to Ym.

The first switch Q1 is turned on at a resonance point of the resonating waveform. If the first switch Q1 is turned on, then the sustain voltage Vs is applied, via the first switch Q1 and the driving IC 42, to the scan electrode lines Y1 to Ym. During the time interval when voltages on the scan electrode lines Y1 to Ym are charged and discharged by such an operation of the energy recovering circuit 41, the fourth switch Q4 keeps an ON state so as to form a current path between the energy recovering circuit 41 and the driving IC 42.

The energy recovering circuit 41 recovers an energy from the PDP and then applies a voltage to the scan electrode lines Y1 to Ym using the recovered energy, thereby reducing an excessive power consumption upon discharging in the set-up interval and in the sustain period.

The negative scan voltage supplier 43 consists of a sixth switch Q6 connected between a third node n3 and a scan voltage source −Vy. The sixth switches Q6 is switched in response to a control signal yw from a timing controller (not shown) during the address period to thereby apply a scan voltage −Vy to the driving IC n4.

The scan reference voltage supplier 44 consists of an eighth switch Q8 connected between a scan reference voltage source Vsc and a fourth node n4. The eighth switch Q8 is switched in response to a control signal SCW from the timing controller (not shown) to thereby apply the scan reference voltage Vsc to the driving IC 42.

The set-up supplier 45 consists of a fourth diode D4 and a third switch Q3 connected between a set-up voltage source Vsetup and a third node n3. The fourth diode D4 shuts off a backward current flowing from the third node n3 into the set-up voltage source Vsetup. The third switch Q3 is switched in response to a control signal setup from the timing controller (not shown) to thereby apply a rising ramp waveform Ramp-up having a slope determined by a RC time constant value to the third node n3.

A procedure in which a control pulse Ramp-p is supplied from the scan electrode driver of the present invention will be described below.

First, since a control signal set-up is applied via a first variable resistor R1, a channel width of the third switch Q3 is controlled by a resistance value of the first variable resistor R1. In real, a channel width of the third switch Q3 is controlled by a capacitance value of a capacitor or a parasitic capacitor (not shown) and a RC time constant of the first variable resistor R1.

Accordingly, a control pulse Ramp-p supplied via the third switch Q3 at a predetermined slope (i.e., the same slope as the rising ramp waveform) is applied, via the third node n3, to the driving IC 42. The control pulse Ramp-p applied to the driving IC 42 is applied, via the driving IC 42, to the scan electrode Y. If the control pulse Ramp-p is applied to the scan electrode Y, then an intensified discharge is generated at the discharge cells to thereby form negative wall charges at the entire scan electrodes Y. After the control pulse Ramp-p was applied to the scan electrodes Y, the second switch Q2 is turned on. If the second switch Q2 is turned on, then a ground voltage GND is applied to the scan electrodes Y.

Such an embodiment of the present invention can apply the control pulse Ramp-p with the aid of the set-up supplier 45 for supplying the rising ramp waveform without any additional circuit for supplying the control pulse Ramp-p.

Figure 8:
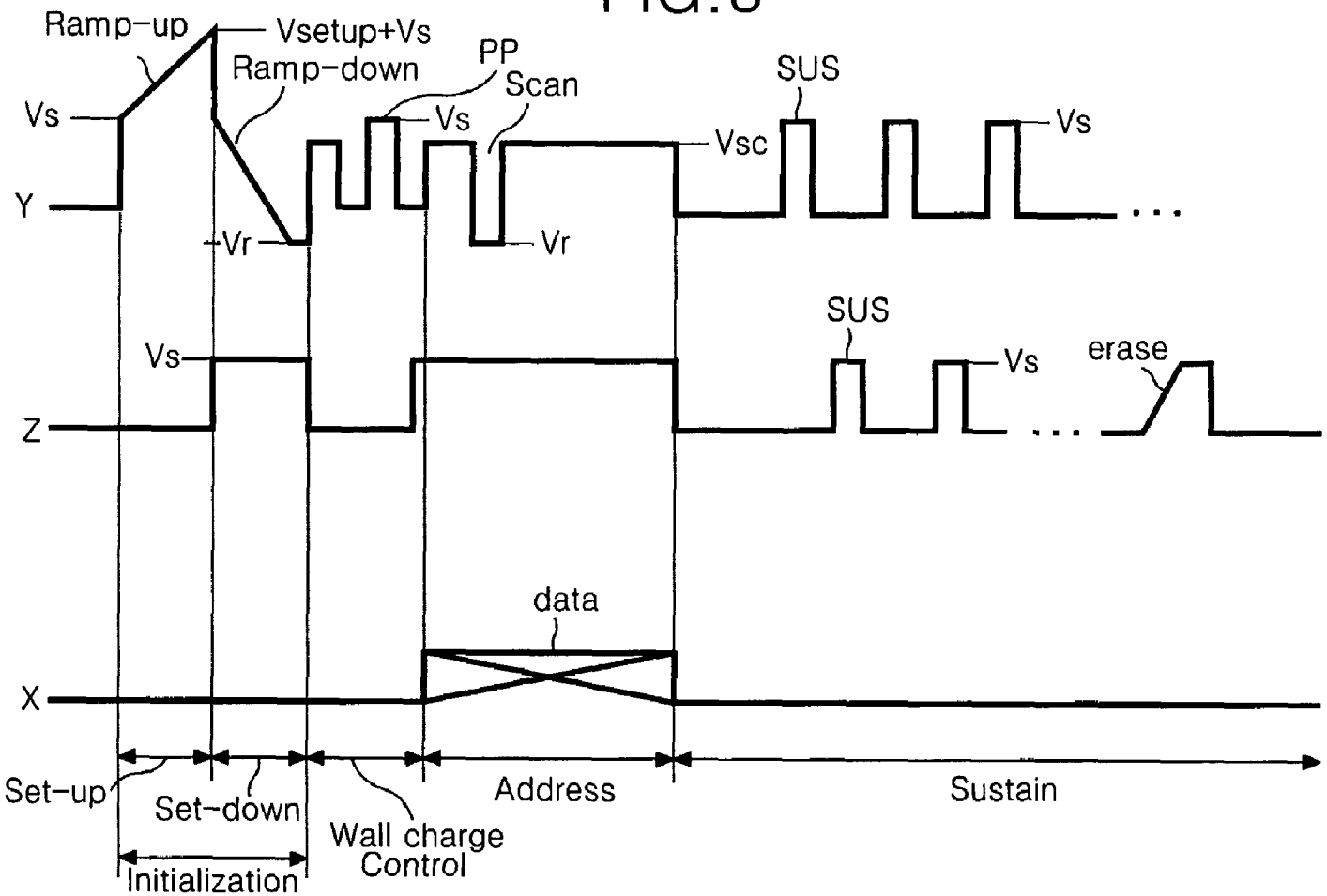
FIG. 8 is a waveform diagram for explaining a method of driving a plasma display panel according to a first embodiment of the present invention.

FIG. 8 shows a method of driving a plasma display panel (PDP) according to a second embodiment of the present invention.

Referring to FIG. 8, the PDP according to the second embodiment of the present invention is divided into an initialization period for initializing the entire field, a wall charge control period for preventing an inversion of wall charges, an address period for selecting a cell and a sustain period for sustaining a discharge of the selected cell for its driving.

In the initialization period, a rising ramp waveform Ramp-up is simultaneously applied to all of scan electrodes Y in a set-up interval. This rising ramp waveform Ramp-up causes a weak discharge within cells at the full field to generate wall charges within the cells. The rising ramp waveform Ramp-up rises from a sustain voltage Vs until a sum value of a set-up voltage Vsetup with the sustain voltage Vs.

In the set-down interval, after the rising ramp waveform Ramp-up was supplied, a falling ramp waveform Ramp-down falling from a positive voltage lower than a peak voltage of the rising ramp waveform Ramp-up is simultaneously applied to the scan electrodes Y. The falling ramp waveform Ramp-down causes a weak erasure discharge within the cells, to thereby erase spurious charges of wall charges and space charges generated by the set-up discharge and uniformly leave wall charges required for the address discharge within the cells of the full field. In real, the falling ramp waveform Ramp-down falls from the sustain voltage Vs until a negative voltage −Vy so that desired wall charges can be left during the set-down interval.

In the wall charge control period, the scan electrodes Y are supplied with a rectangular control pulse pp rising from a ground voltage GND until a sustain voltage Vs. If the rectangular control pulse pp is applied to the scan electrodes Y, then a discharge is generated at the discharge cells to thereby control the polarities of the discharge cells into desired types.

More specifically, in the set-down interval, wall charges having an undesired type of polarities are formed at a portion of discharge cells as shown in FIG. 5. Thereafter, if the rectangular control pulse pp is applied to the scan electrodes Y, then a discharge is generated at the discharge cells to thereby form negative wall charges at the scan electrodes Y while forming positive wall charges at the sustain electrodes Z. In other words, in the embodiment of the present invention, the polarities of wall charges of the entire discharge cells can be controlled into desired polarities during the wall charge control period.

Meanwhile, an application time of the control pulse pp is set within 1 μs. For instance, an application time of the control pulse pp may be set more shortly as it goes from the initial sub-field into the later sub-fields. Alternatively, an application time of the control pulse pp may be set longer as it goes from the initial sub-field into the later sub-fields. In real, an application time of the control pulse pp is experimentally determined in consideration of a length (i.e., inch) of the panel, a resolution of the panel and a process state, etc. Further, a scan reference voltage Vsc is applied to the scan electrode Y prior to an application of the control pulse pp.

In the address period, a negative scanning pulse scan is sequentially applied to the scan electrodes Y and, at the same time, a positive data pulse data is applied to the address electrodes X. A voltage difference between the scanning pulse scan and the data pulse data is added to a wall voltage generated in the initialization period to thereby generate an address discharge within the cells supplied with the data pulse data. Wall charges are formed within the cells selected by the address discharge. In the above-mentioned embodiment of the present invention, negative wall charges are formed at the scan electrodes Y of the entire discharge cells during the wall charge control period to thereby cause a stable address discharge. Accordingly, it becomes possible to prevent a miswriting and/or a spot misfire.

Meanwhile, a positive direct current voltage having a sustain voltage level Vs is applied to the sustain electrodes Z during the set-down interval and the address period. Further, in the wall charge control period, the sustain electrodes Z are supplied with a ground voltage GND. The sustain electrodes Z are supplied with the ground voltage GND during the wall charge control period to thereby cause a stable intensified discharge.

In the sustain period, a sustaining pulse sus is alternately applied to the scan electrodes Y and the sustain electrodes Z. Then, a wall voltage within the cell selected by the address discharge is added to the sustain pulse sus to thereby generate a sustain discharge taking a surface-discharge type between the scan electrode Y and the common sustain electrode Z whenever each sustain pulse sus is applied. Finally, after the sustain discharge was finished, an erasing ramp waveform erase having a small pulse width is applied to the sustain electrode Z to thereby erase wall charges left within the cells.

In the mean time, in FIG. 8, the control pulse pp can be supplied by means of the scan electrode driver shown in FIG. 7. This will be described with reference to FIG. 7 below.

First, an eighth switch Q8 is turned on during the wall charge control period to thereby apply a scan reference voltage Vsc to the scan electrodes Y. Thereafter, a second switch Q2 is turned on, to thereby apply a ground voltage GND to the scan electrodes Y. After the ground voltage GND was applied to the scan electrodes Y, a first switch Q1 is switched (e.g., during a time less than 1 μs), to thereby apply a control pulse pp having a sustain voltage level Vs to the scan electrodes Y. Thereafter, the ground voltage GND, the scan reference voltage Vs and a scan voltage −Vr are applied to the scan electrodes Y, to thereby cause an address discharge.

As described above, according to the present invention, a control pulse is applied after the reset period to thereby prevent an inversion phenomenon of wall charges. In other words, a positive control pulse is applied to the scan electrodes after the reset period to thereby form negative wall charges at the entire scan electrodes. Accordingly, it becomes possible to generate a stable address discharge and thus to prevent a miswriting and a spot misfire.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display apparatus comprising:

a scan electrode and a sustain electrode formed on a first substrate;

an address electrode formed on a second substrate;

a plurality of barrier ribs provided between the first and second substrate; and a cell being defined by the scan, sustain and address electrodes, and the plurality of barrier ribs, wherein the plasma display apparatus is configured to provide at least one signal to at least one of the scan electrode, the sustain electrode or the address electrode, and the at least one signal includes an initialing pulse, which is provided to said scan electrode during an initialization period, a scanning pulse, which is provided to said scan electrode during an address period, a first sustaining pulse, which is provided to said scan electrode during a sustain period, and a second sustaining pulse, which is provided to said sustain electrode during the sustain period, wherein at least one prescribed pulse of a prescribed waveform shape, provided to said scan electrode after said initialing pulse and before said scanning pulse.

2. The plasma display apparatus as claimed in claim 1, wherein said initialization period includes a set-up period in which said initialing pulse changes to a second voltage after said initialing pulse has changed to a first voltage, wherein said second voltage is higher than said first voltage.

3. The plasma display apparatus as claimed in claim 2, wherein said first voltage is substantially equal to a peak voltage of said prescribed pulse.

4. The plasma display apparatus as claimed in claim 2, wherein said second voltage is higher than a peak voltage of said prescribed pulse.

5. The plasma display apparatus as claimed in claim 1, 2, 3, or 4, wherein said initialization period includes a set-down period in which said initialing pulse changes to a fourth voltage after said initialing pulse has changed a third voltage, wherein said fourth voltage is lower than said third voltage.

6. The plasma display apparatus as claimed in claim 5, wherein said third voltage is substantially equal to a peak voltage of said prescribed pulse.

7. The plasma display apparatus as claimed in claim 1, wherein a peak voltage of said prescribed pulse is substantially equal to a peak voltage of said sustaining pulse.

8. The plasma display apparatus as claimed in claim 1, wherein a peak voltage of said prescribed pulse is higher than a scan reference voltage provided to the scan electrode.

9. The plasma display apparatus of claim 3, 4, 7, or 8, wherein the peak voltage is provided for a prescribed time period.

10. The plasma display apparatus as claimed in claim 1, wherein said initialing pulse is longer than said prescribed pulse.

11. The plasma display apparatus as claimed in claim 1, wherein a ground voltage is applied to said scan electrode before said prescribed pulse is applied.

12. The plasma display apparatus as claimed in claim 1, wherein a voltage provided to said scan electrode before said prescribed pulse is substantially equal to a voltage which is applied just before said initialing pulse.

13. The plasma display apparatus as claimed in claim 1, wherein a voltage of said scanning pulse is lower than a voltage which is applied just before said address period.

14. The plasma display apparatus as claimed in claim 1, wherein said prescribed pulse is provided at least two times between said initialing pulse and said scanning pulse.

15. The plasma display apparatus of claim 1, wherein the at least one prescribed pulse is provided during a prescribed period between the initialization period and the address period.

16. The plasma display apparatus of claim 15, wherein the initialization period, the prescribed period, the address period and sustain period are provided in at least one sub-field of a frame.

17. The plasma display apparatus of claim 16, wherein the at least one sub-field includes eight sub-fields.

18. The plasma display apparatus of claim 16, wherein a cumulative length of time of the initialization period, prescribed period and the address period is the same for every sub-field of the frame.

19. The plasma display apparatus of claim 18, wherein the sustain period is different for every sub-field of the frame.

20. The plasma display apparatus of claim 1, wherein the first sustaining pulse and the second sustaining pulse are alternately applied to the scan electrode and the sustain electrode, respectively, during the sustain period, wherein the first and second sustaining pulses have substantially the same peak voltage.

21. The plasma display apparatus of claim 1, wherein each of the scan and sustain electrode includes at least a strip of transparent material, and a bus electrode of a narrower width than the strip formed on the transparent material.

22. The plasma display apparatus of claim 21, wherein a phosphorous material is provided within the cell.

23. The plasma display apparatus of claim 1, wherein at least one data pulse is provided to the address electrode during the address period.

24. The plasma display apparatus of claim 1, wherein at least one of the initializing pulse, scanning pulse, first sustaining pulse, second sustaining pulse or prescribed pulse causes at least one discharge in the cell.

25. A plasma display apparatus comprising:

a scan electrode and a sustain electrode formed on a first substrate;

an address electrode formed on a second substrate;

a plurality of barrier ribs provided between the first and second substrate; and a cell being defined by the scan, sustain and address electrodes, and the plurality of barrier ribs, wherein the plasma display apparatus is configured to provide at least one signal to at least one of the scan electrode, the sustain electrode or the address electrode, and the at least one signal includes an initialing pulse, which is provided to said scan electrode during an initialization period, a scanning pulse, which is provided to said scan electrode during an address period, a first sustaining pulse, which is provided to said scan electrode during a sustain period, and a second sustaining pulse, which is provided to said sustain electrode during the sustain period, wherein at least one prescribed pulse of a prescribed waveform shape, is provided to said scan electrode after said initialing pulse and before said scanning pulse, wherein a peak voltage value of said prescribed pulse is substantially equal to a peak voltage value of said sustaining pulse, said initialing pulse is longer than said prescribed pulse, and a voltage of said scanning pulse is lower than a voltage which is applied just before said address period.

26. The plasma display apparatus as claimed in claim 25, wherein said initialization period includes a set-up period in which said initialing pulse changes to a second voltage after said initialing pulse has changed to a first voltage, wherein said second voltage is higher than said first voltage.

27. The plasma display apparatus as claimed in claim 26, wherein said first voltage is substantially equal to a peak voltage of said prescribed pulse.

28. The plasma display apparatus as claimed in claim 26, wherein said second voltage is higher than a peak voltage of said prescribed pulse.

29. The plasma display apparatus as claimed in claim 25, 26, 27, or 28, wherein said initialization period includes a set-down period in which said initialing pulse changes to a fourth voltage after said initialing pulse has changed a third voltage, wherein said fourth voltage is lower than said third voltage.

30. The plasma display apparatus as claimed in claim 29, wherein said third voltage is substantially equal to a peak voltage of said prescribed pulse.

31. The plasma display apparatus as claimed in claim 25, wherein a peak voltage of said prescribed pulse is higher than a scan reference voltage provided to the scan electrode.

32. The plasma display apparatus of claim 27, 28, or 31, wherein the peak voltage is provided for a prescribed time period.

33. The plasma display apparatus as claimed in claim 25, wherein a ground voltage is applied to said scan electrode before said prescribed pulse is applied.

34. The plasma display apparatus as claimed in claim 25, wherein a voltage provided to said scan electrode before said prescribed pulse is substantially equal to a voltage which is applied just before said initialing pulse.

35. The plasma display apparatus as claimed in claim 25, wherein said prescribed pulse is provided at least two times between said initialing pulse and said scanning pulse.

36. The plasma display apparatus of claim 25, wherein the at least one prescribed pulse is provided during a prescribed period between the initialization period and the address period.

37. The plasma display apparatus of claim 36, wherein the initialization period, the prescribed period, the address period and sustain period are provided in at least one sub-field of a frame.

38. The plasma display apparatus of claim 37, wherein the at least one sub-field includes eight sub-fields.

39. The plasma display apparatus of claim 37, wherein a cumulative length of time of the initialization period, prescribed period and the address period is the same for every sub-field of the frame.

40. The plasma display apparatus of claim 39, wherein the sustain period is different for every sub-field of the frame.

41. The plasma display apparatus of claim 25, wherein the first sustaining pulse and the second sustaining pulse are alternately applied to the scan electrode and the sustain electrode, respectively, during the sustain period, wherein the first and second sustaining pulses have substantially the same peak voltage.

42. The plasma display apparatus of claim 25, wherein each of the scan and sustain electrode includes at least a strip of transparent material, and a bus electrode of a narrower width than the strip formed on the transparent material.

43. The plasma display apparatus of claim 42, wherein a phosphorous material is provided within the cell.

44. The plasma display apparatus of claim 25, wherein at least one data pulse is provided to the address electrode during the address period.

45. The plasma display apparatus of claim 25, wherein at least one of the initializing pulse, scanning pulse, first sustaining pulse, second sustaining pulse or prescribed pulse causes at least one discharge in the cell.

46. A plasma display apparatus comprising:

a scan electrode and a sustain electrode formed on a first substrate;

an address electrode formed on a second substrate;

a plurality of barrier ribs provided between the first and second substrate; and a cell being defined by the scan, sustain and address electrodes, and the plurality of barrier ribs, wherein the plasma display apparatus is configured to provide at least one signal to at least one of the scan electrode, the sustain electrode or the address electrode, and the at least one signal includes an initialing pulse, which is provided to said scan electrode during an initialization period, a scanning pulse, which is provided to said scan electrode during an address period, a first sustaining pulse, which is provided to said scan electrode during a sustain period, and a second sustaining pulse, which is provided to said sustain electrode during the sustain period, wherein at least one prescribed pulse of a prescribed waveform shape, is provided to said scan electrode after said initialing pulse and before said scanning pulse, wherein said initialization period includes a set-up period in which said initialing pulse changes to a second voltage after said initialing pulse has changed to a first voltage, said second voltage being higher than said first voltage, said initialization period includes a set-down period in which said initialing pulse changes to a fourth voltage after said initialing pulse has changed a third voltage, said fourth voltage being lower than said third voltage, and said initialing pulse is longer than said prescribed pulse.

47. The plasma display apparatus as claimed in claim 46, wherein said first voltage is substantially equal to a peak voltage of said prescribed pulse.

48. The plasma display apparatus as claimed in claim 46, wherein said second voltage is higher than a peak voltage of said prescribed pulse.

49. The plasma display apparatus as claimed in claim 46, 47 or 48, wherein said third voltage is substantially equal to a peak voltage of said prescribed pulse.

50. The plasma display apparatus as claimed in claim 46, wherein a peak voltage of said prescribed pulse is substantially equal to a peak voltage of said sustaining pulse.

51. The plasma display apparatus as claimed in claim 46, wherein a peak voltage of said prescribed pulse is higher than a scan reference voltage provided to the scan electrode.

52. The plasma display apparatus of claim 47, 48, 50, or 51, wherein the peak voltage is provided for a prescribed time period.

53. The plasma display apparatus as claimed in claim 46, wherein a ground voltage is applied to said scan electrode before said prescribed pulse is applied.

54. The plasma display apparatus as claimed in claim 46, wherein a voltage provided to said scan electrode before said prescribed pulse is substantially equal to a voltage which is applied just before said initialing pulse.

55. The plasma display apparatus as claimed in claim 46, wherein a voltage of said scanning pulse is lower than a voltage which is applied just before said address period.

56. The plasma display apparatus as claimed in claim 46, wherein said prescribed pulse is provided at least two times between said initialing pulse and said scanning pulse.

57. The plasma display apparatus of claim 46, wherein the at least one prescribed pulse is provided during a prescribed period between the initialization period and the address period.

58. The plasma display apparatus of claim 57, wherein the initialization period, the prescribed period, the address period and sustain period are provided in at least one sub-field of a frame.

59. The plasma display apparatus of claim 58, wherein the at least one sub-field includes eight sub-fields.

60. The plasma display apparatus of claim 58, wherein a cumulative length of time of the initialization period, prescribed period and the address period is the same for every sub-field of the frame.

61. The plasma display apparatus of claim 60, wherein the sustain period is different for every sub-field of the frame.

62. The plasma display apparatus of claim 46, wherein the first sustaining pulse and the second sustaining pulse are alternately applied to the scan electrode and the sustain electrode, respectively, during the sustain period, wherein the first and second sustaining pulses have substantially the same peak voltage.

63. The plasma display apparatus of claim 46, wherein each of the scan and sustain electrode includes at least a strip of transparent material, and a bus electrode of a narrower width than the strip formed on the transparent material.

64. The plasma display apparatus of claim 63, wherein a phosphorous material is provided within the cell.

65. The plasma display apparatus of claim 46, wherein at least one data pulse is provided to the address electrode during the address period.

66. The plasma display apparatus of claim 46, wherein at least one of the initializing pulse, scanning pulse, first sustaining pulse, second sustaining pulse or prescribed pulse causes at least one discharge in the cell.

* * * * *